United States Patent [19]

Kirtland

[11] Patent Number: 4,527,949

[45] Date of Patent: Jul. 9, 1985

[54] VARIABLE WIDTH DIFFUSER

[75] Inventor: Howard W. Kirtland, No. Syracuse, N.Y.

[73] Assignee: Carrier Corporation, Syracuse, N.Y.

[21] Appl. No.: 531,019

[22] Filed: Sep. 12, 1983

[51] Int. Cl.[3] ..... F04D 27/02

[52] U.S. Cl. ..... 415/150; 415/156; 415/158; 415/211

[58] Field of Search ..... 415/126, 146, 147, 148, 415/149 R, 150, 156, 157, 158, 189, 186, 211; 62/226

[56] References Cited

U.S. PATENT DOCUMENTS

| | | | |
|---|---|---|---|
| 2,778,564 | 1/1957 | Halford et al. | 415/149 R |
| 2,846,185 | 8/1958 | Widmer | 415/150 |
| 2,996,996 | 8/1961 | Jassniker | 415/150 UX |
| 3,780,532 | 12/1973 | Norbeck et al. | 62/226 X |
| 3,957,392 | 5/1976 | Backburn | 415/146 |
| 4,219,305 | 8/1980 | Mount et al. | 415/158 X |
| 4,378,194 | 3/1983 | Bandukwalla | 415/158 X |

*Primary Examiner*—Robert E. Garrett
*Assistant Examiner*—Joseph M. Pitko
*Attorney, Agent, or Firm*—Thomas J. Wall

[57] ABSTRACT

A centrifugal machine having a variable diffuser that includes a radially disposed fixed wall and an opposed movable wall defining the diffuser passage. Guideways are formed in the movable wall in which a series of diffuser vanes are slidably mounted. A spring biased retainer loosely holds each of the vanes in an associated guideway and urges the vanes into seating contact with the fixed wall so that each vane can adjust its position in assembly to accommodate for changes in diffuser alignment due to thermal growth or the like.

18 Claims, 3 Drawing Figures

VARIABLE WIDTH DIFFUSER

BACKGROUND OF THE INVENTION

This invention relates generally to centrifugal machines and in particular to a variable width diffuser for use in a centrifugal machine.

Centrifugal compressors used in refrigeration systems are generally required to operate over a relatively large flow range. The efficiency and stability of the compressor, to a large extent, is dependent upon the diffuser's ability to convert kinetic energy contained in the working fluid leaving the impeller into static pressure. As the load on the machine changes, the volumetric rate of flow through the diffuser correspondingly changes. With a fixed diffuser geometry, the flow through the diffuser passage becomes unstable as the flow rate decreases below a certain level. Further reduction in the flow rate leads to a surge condition whereupon the working fluids undergo periodic flow reversals in the diffuser passage. This, of course, creates a good deal of unwanted noise and destroys the efficiency of the machine. If the rate of flow through the machine increases, the diffuser will be incapable of handling the flow through the fixed passage and a choke condition is soon reached which again adversely affects machine performance and efficiency.

Many schemes have been devised to maintain high machine efficiencies over a wide operation range. In U.S. Pat. No. 4,070,123, the entire impeller wheel configuration is varied in response to load changes in an effort to match the machine performance with the changing load demands. Adjustable diffuser flow restrictors are also described in U.S. Pat. No. 3,362,625 which serve to regulate the flow within the diffuser in an effort to improve stability at low volumetric flow rates. Variable diffuser vanes as disclosed in U.S. Pat. No. 3,957,392 are used for the same purpose. In U.S. Pat. No. 3,251,539, a centrifugal refrigerant compressor is described having a movable diffuser wall that is used to change the width of the diffuser passage. The width of the diffuser passages is changed in response to changes made in the position of compressor inlet guide vanes. Again, by matching the geometry of the diffuser to the inlet flow, surging at low flow rates is avoided. A similar device is also shown in U.S. Pat. No. 4,219,305.

One effective technique for maintaining high operating efficiency over a wide flow range in a centrifugal machine is through use of the variable width diffuser in conjunction with fixed diffuser guide vanes. This type of arrangement is shown in U.S. Pat. Nos. 2,996,996 and 4,378,194 as well as in British Pat. No. 305,214. In these arrangements, the diffuser vanes are securely affixed, as by welding, to one of the opposed diffuser walls. The vanes are adapted to pass through openings formed in the other wall thus permitting the geometry of diffuser to be changed in response to changing load conditions. Fixedly mounting the diffuser blades to one of the diffuser walls presents a number of problems particularly in regard to the manufacture, maintenance and operation of the machine. Little space is afforded for securing the vanes in assembly. Any misalignment of the vanes will cause the vane to bind or rub against the opposite wall as it is being repositioned. Similarly, if one or more vanes in the series has to be replaced in assembly, the entire machine generally must be torn down to effect the replacement. This requires a good deal of down time and is costly. The receiving opening, through which the vanes pass are sometimes made overly large to avoid alignment problems. This can produce unwanted loss of working fluids and pressure variations in the diffuser region which again adversely affects performance. Lastly, the machine is generally exposed to thermal growth in the course of normal operations. The magnitude of growth may exceed manufacturing tolerance resulting in binding and/or rubbing problems as the width of the diffuser passage is being changed to meet changing load conditions.

SUMMARY OF THE INVENTION

It is therefore a primary object of the present invention to improve centrifugal machines.

A further object of the present invention is to improve a centrifugal compressor having a variable width diffuser.

It is a further object of the present invention to avoid alignment problems in a variable width diffuser section utilizing fixed diffuser guide vanes.

Another object of the present invention is to provide self aligning diffuser vanes in a variable width diffuser.

Yet another object of the present invention is to minimize leakage and uncontrollable pressure variations in a variable width diffuser having fixed diffuser blades mounted in the diffuser passage.

A still further object of the present invention is to provide self aligning diffuser vanes in a movable wall diffuser that can be quickly replaced in assembly without having to tear down the machine.

Another object of the present invention is to alter the performance of a centrifugal machine while the machine is operating.

These and other objects of the present invention are attained by a centrifugal machine having a diffuser that includes a fixed wall and an opposing movable wall, a control mechanism to position the movable wall to change the width of the diffuser passage and a series of self aligning diffuser vanes slidably mounted in the repositionable wall, and a biasing mechanism for urging the vanes into seating contact against the opposing surface of the fixed wall.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figure 1:
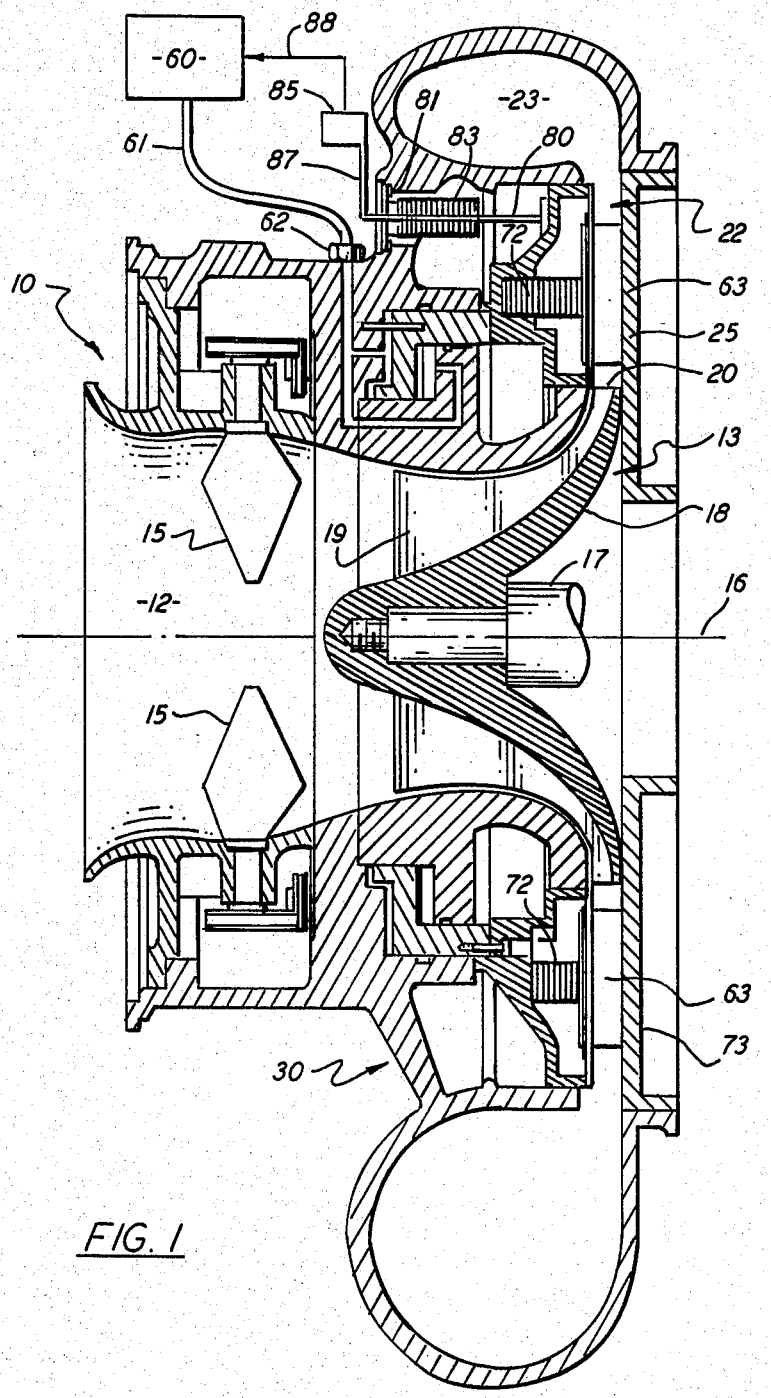
FIG. 1 is a partial side elevation in section of a centrifugal machine embodying the teaching of the present invention.

Referring now to the drawings wherein like numbers are used to identify like elements throughout, attention is initially directed to FIG. 1 which illustrates a centrifugal compressor of the type utilized in the refrigeration art to raise the pressure of a refrigerant (working fluid) utilized in a cooling cycle. The machine is generally referenced 10 and includes an axial inlet 12 that directs the refrigerant into a rotating impeller wheel assembly 13 through a series of adjustable inlet guide vanes 15—15. The impeller is secured to a drive shaft 17 by any suitable means to align the impeller assembly along the axis 16 of the machine. The impeller assembly includes a central hub 18 that supports a series of contoured blades 19. The blades are arranged to create passages therebetween that turn the incoming axial flow of refrigerant in a radial direction and discharge the compressed refrigerant from the blade tips 20 into a diffuser section generally depicted at 22. The diffuser surrounds the impeller and functions to direct the compressed fluid into a toroidal-shaped volute or collector 23 which carries the fluids to the machine exhaust.

The general construction of the centrifugal compressor is well known and, for this reason the structure of the machine is shown in somewhat schematic form in the drawings. As will become apparent from the disclosure below, the apparatus of the present invention involves a variable width diffuser having fixed diffuser guide vanes that can be utilized with equal effect in a wide variety of centrifugal machines. The machine shown herein is thus meant to be illustrative of a centrifugal compressor and not to be limiting in any sense. The term "fixed diffuser vane" is also used herein to define an airfoil whose pitch or angle of attack in regard to the compressed fluids moving through the diffuser passage does not change. The machine performance is herein altered while the machine is operated by adjusting the diffuser width.

Figure 2:
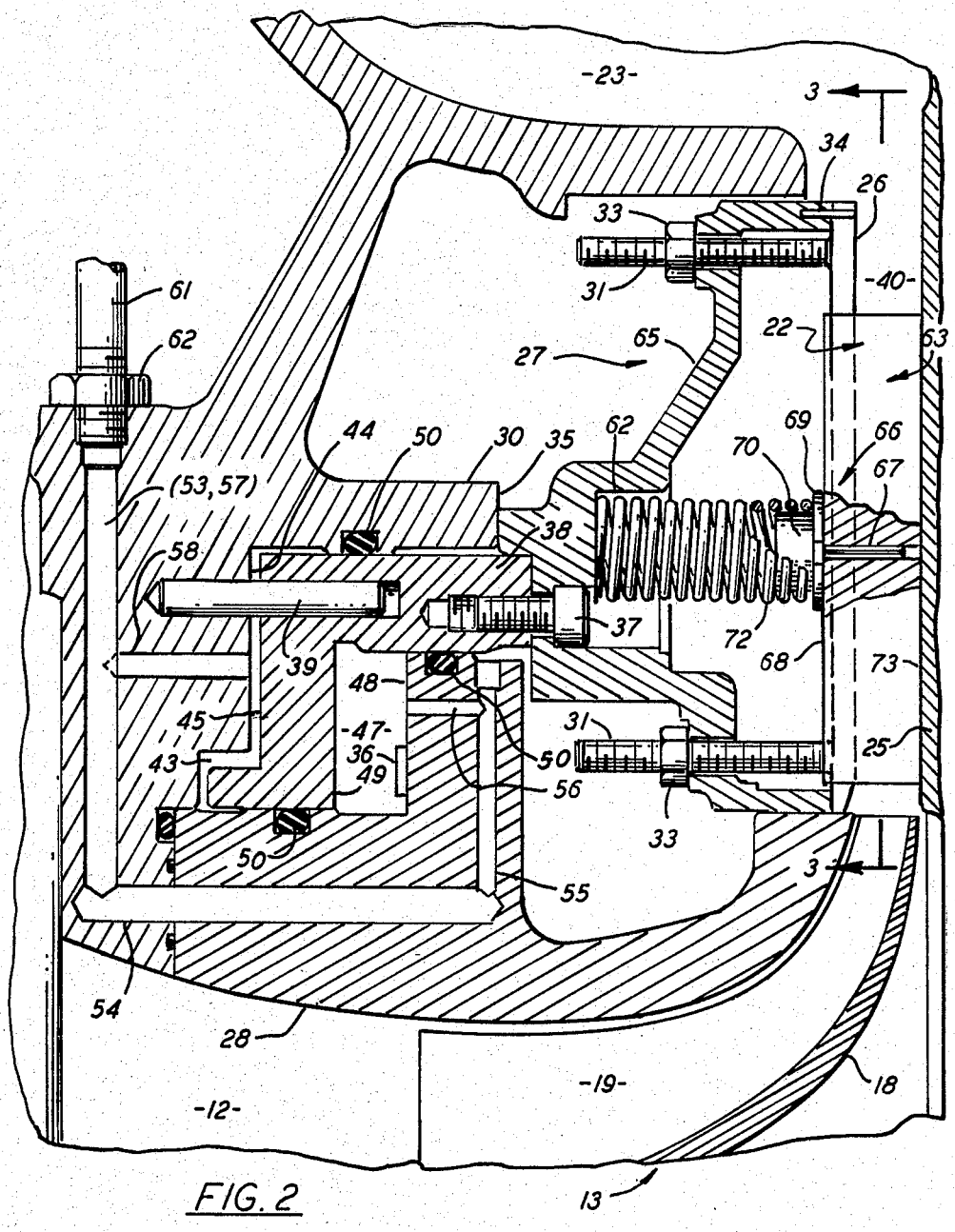
FIG. 2 is an enlarged view of the upper portion of the machine illustrated in FIG. 1 further illustrating the variable width diffuser section utilized therein.
Figure 3:
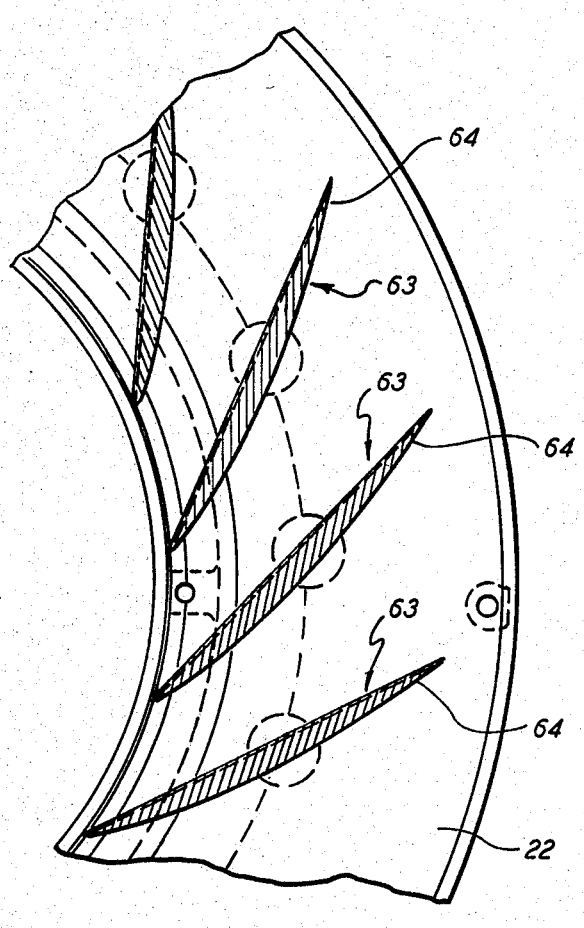
FIG. 3 is a view taken along lines 3—3 in FIG. 2 showing a number of diffuser vanes slidably mounted in the movable wall of the diffuser.

Referring now more specifically to FIGS. 2 and 3, diffuser section 22 includes a radially disposed fixed wall 25 that forms the back wall of the diffuser section. The front wall 26 of the diffuser is also radially disposed in regard to the impeller and is arranged to move axially towards and away from the fixed wall to alter the width of the annular diffuser passage 40 and thus alter the machine's operating characteristics in regard to varying load demands. In order to maximize the machine's efficiency in response to varying flow conditions, it is desirous to maintain the flow rate through the diffuser to just above the surge condition without causing a stall.

The movable front wall of the diffuser is secured to a carriage generally referenced 27. The carriage is movably mounted in the machine between shroud 28 and the main casing 30. Studs are welded to the back of wall 26 and are adapted to pass through openings in the diffuser housing. Nuts 33—33 are used to draw wall 26 tightly against the front face of the carriage. The wall 26 is accurately located in assembly by means of dowel pins, such as dowel 34.

The carriage is illustrated in FIG. 2 as being fully retracted against the stop face 35 on the main casing to open the diffuser passage to a maximum flow handling condition. The carriage, in turn, is securely affixed via screws 37 to a double acting piston 38. Although the piston may be driven either by gas or liquid, it shall be assumed for explanatory purposes it is liquid actuated. By introducing fluid under pressure to either side of the piston, its axial position, and thus that of the affixed carriage can be controlled in assembly. The piston is also slidably mounted between the previously noted shroud 28 and the main casing 30 so that it can move wall 26 through means of the carriage between the previously noted maximum flow position against stop 35 and a minimum flow position wherein the front face of the piston is brought against a stop 36.

A first expandable chamber 43 is provided between the casing wall surface 44 and the front face 45 of the piston. Delivering fluid under pressure into the chamber drives the piston axially toward the fixed wall 25 of the diffuser. A second expandable chamber 47 is similarly located between the back wall surface 49 of the piston and the shroud wall 48. Directing fluid under pressure at this chamber causes the piston to be driven forward thus increasing the width of the diffuser passage.

Fluid is delivered into the chambers from a supply reservoir, not shown, by means of a pair of flow circuits. The first flow circuit leading to chamber 43 includes flow channels 57 and 58. The second circuit is more complex and is made up of channels 53–56 which coact to deliver the drive fluid into the second chamber 47. In practice, the channels are formed by drilling communicating holes into the machine elements and plugging the holes where appropriate. In practice, inlet channels 53 and 57 are drilled one behind the other and thus appear as a single channel in FIG. 2. Both inlet channels are connected to supply lines 61 by means of threaded couplings 62.

A suitable control system 60 (FIG. 1) containing electrically actuated valves regulates the flow of the drive fluid into and out of the two expandable chambers to either move the piston towards or away from the fixed diffuser wall 25. An anti-rotation pin 39 passes between the piston and the machine casing which prevents the piston from turning in assembly. A series of O-ring seals 50—50 encircle the piston and prevent fluid from passing along the piston wall between chambers. Through manipulation of the control valves, the position of the carriage and thus the width of the diffuser passage can be closely regulated to match the performance characteristics to load demands.

A series of fixed diffuser guide vanes 63—63 are equally spaced about the movable wall of the diffuser as illustrated in FIG. 3. The vanes can be of any suitable contour and generally take the shape of an airfoil for controlling the movement of working fluids through the diffuser passage. The vanes usually will turn the incoming flow leaving the tip of the impeller into a path that will combat unwanted noise and vibrations at low volumetric flow rates. The vanes are slidably contained in the movable wall within contoured holes 64—64 that complement closely the periphery of the vanes. A close running fit is provided therebetween to permit the vanes to move freely in the holes while at the same time minimizing fluid and pressure loss in the diffuser passage.

Positioned immediately behind each vane in the assembly is a biasing spring 72. The spring is a compression coil that is seated at one end in a circular recess 62 formed in the rear wall of the carriage. The other end of each spring is loosely mounted upon a spring retaining element 66 that is pinned to the bottom surface 68 of an opposed vane via pin 67. The spring retaining element includes an expanded flange 69 that abuts the connected diffuser vane and a rearwardly projected cylinder 70 that passes into the spring coil. In assembly, each spring is loaded between the carriage and the retainer flange to urge the bottom surface of the vane into secure seating contact against the interior surface of the fixed diffuser wall. The action of the spring is such to hold the vane against the opposite wall over the entire travel distance of the carriage-piston combination between stops 35 and 36. The bottom surface 73 of each vane complements the receiving surface of the wall 25 and provides sufficient contact area so that the vane will not cant in assembly. This, coupled with the slidable mounting of the vanes and the loose spring retention, allows each of the vanes to be self-aligning in assembly. The vanes thus can automatically alter their relative positions to accommodate for changes in the size and location of elements due to thermal growth or the like. Similarly, because of this independent flexible mounting structure, manufacturing and assembly tolerances can be considerably relaxed when compared to other variable wall diffusers having the vanes welded or bolted to one of the walls.

A sensing rod 80 (FIG. 1) is slidably mounted within the machine casing by means of a mounting bracket 81. The rod is connected to a bellows 83 which functions to seal the rod within movable wall 26. The rod is adapted to move with the wall as it is moved to different positions. A sensing circuit 85 is operably connected to the proximal end of the rod by means of a pivot arm 87. The arm responds to the linear displacement of the rod to detect the exact position of the movable wall. Circuit means are provided which generate an output signal indicative of the wall position and this information is transmitted via data line 88 to control system 60 where it is used in conjunction with other load data to position the wall in an optimum position for any given load.

The vaneless or uncontrolled radial distance along the diffuser passage is preferably maintained at about or less than 10% of the overall impeller radius in order to provide for good aerodynamic flow characteristics through the variable range of the diffuser. Also, because of the self-adjusting feature of the present blade arrangement, the clearance between the blades and the receiving opening can be held to about 0.010″ without the vanes binding in the holes as the movable wall is moved between the maximum and minimum flow positions.

While this invention has been described with reference to the structure disclosed herein, it is not confined to the details set forth and this application is intended to cover any modifications or changes as may come within the scope of the following claims.

I claim:

1. In a centrifugal machine having a casing and an impeller rotatably mounted therein for bringing a working fluid from an inlet to the entrance of an annular radial disposed diffuser, said diffuser including a radially disposed fixed wall, a carriage for supporting a radially disposed movable wall adjacent the fixed wall to define a diffuser passage, drive means operably connected to the carriage for positioning said carriage in relation to the fixed wall whereby the size of the diffuser passage may be varied, a series of diffuser vanes slidably mounted in complementary holes formed in the movable wall, said diffuser vanes passing through the movable wall and being seated against the fixed wall, and a biasing spring mounted in the carriage for movement therewith behind each diffuser vane, said spring being loaded between the carriage and the back surface of said diffuser vane to hold the vane in seating contact with the fixed wall as the carriage repositions the movable wall.

2. The machine of claim 1 wherein said biasing spring is a coiled compression spring that is mounted at one end in a circular recess formed in the carriage.

3. The machine of claim 2 that further includes a cylindrical mounting member secured to the back surface of each vane that extends rearwardly and being received within the other end of said coil spring to loosely support the diffuser vane in the movable wall.

4. The machine of claim 1 wherein a close running fit is maintained between the periphery of each diffuser vane and the receiving hole formed in the movable wall to minimize movement of working fluids moving through the wall.

5. The machine of claim 1 wherein said drive means includes a double acting piston mounted for axial movement within the machine.

6. The machine of claim 5 that further includes a control means for regulating the positioning of said piston in response to the load demands on the machine.

7. The machine of claim 6 wherein said control means further includes a sensing means for determining the location of the movable wall.

8. In a centrifugal machine having a casing for rotatably supporting an impeller for bringing working fluids to the entrance of a diffuser, said diffuser including a radially disposed fixed wall and a similarly disposed movable wall adjacent thereto for varying the size of the diffuser passage, drive means operatively connected to the movable wall to selectively position the movable wall in regard to the fixed wall between a maximum flow position and a minimum flow position, said movable wall having a series of airfoil shaped vanes slidably contained within complementary openings formed therein, said vanes passing through said movable wall and resting against the fixed wall whereby the vanes span the diffuser passage, and biasing means acting against the back of each vane to urge the vane into seating contact with the fixed wall so that the vane is self-adjusting in assembly.

9. The diffuser of claim 8 that further includes a carriage upon which the movable wall is mounted for axial movement therewith towards and away from the fixed wall.

10. The diffuser of claim 9 wherein said biasing means further includes a spring means that acts between the carriage and said vanes for urging the vanes into seating contact against the fixed wall.

11. The diffuser of claim 9 wherein said drive means further includes a double acting piston that is slidably mounted in the machine casing.

12. The diffuser of claim 8 that further includes a guide means for directing the movable wall along a path of travel generally normal to the fixed wall.

13. The diffuser of claim 8 wherein the uncontrolled distance along the diffuser passage is about or less than the outside radius of the impeller.

14. The diffuser of claim 8 wherein the clearance between each vane and the opening in the movable wall is about 0.010″.

15. In a refrigeration system of the type having a condenser; an evaporator; and a centrifugal compressor including a casing, an impeller means rotatably mounted in said casing, and a chamber means generally circumferentially disposed about said impeller means; a diffuser assembly for said centrifugal compressor, comprising:

a fluid passage means being generally disposed about said impeller means and including generally oppositely disposed wall members forming therebetween a passage extending between said impeller means and said chamber means one of said wall members being fixed against relative movement and the other said wall member being movable relative to said one wall member between a first maximum spaced-apart position and a second minimum spaced-apart position, means operatively connected to said other wall member for selectively moving said other wall member relative to said one wall member, whereby the width of said passage can be selectively varied, and a plurality of vanes circumferentially disposed in said passage and being slidably received in a respective plurality of complimentary-shaped openings in said movable other wall member said vanes continuously spanning the distance between said wall members as said other wall member is moved between the first and the second positions said vanes having respective end surface being independently urged in abutting relationship against said one wall member, whereby each said vane is independently self-aligning to maintain its respective abutting relationship with said one wall member to thereby accommodate any physical changes due to thermal or like expansion or contraction.

16. The machine of claim 15 further comprising a plurality of biasing means in operative engagement with respective oppositely disposed end surfaces of said vanes for independently urging said vanes into abutting relationship against said one wall member during the movement of said other wall member between the first and second positions.

17. The machine of claim 16 wherein said plurality of biasing means are a like plurality of springs operatively engaged with respective said oppositely disposed end surfaces.

18. The machine of claim 17 wherein each said oppositely disposed end surface of each said vane includes a spring-retaining pin extending outwardly therefrom and loosely receivable in an end of a respective said spring, thereby freely supporting each said vane in its respective opening in said other wall member.

* * * * *